US007898373B2

(12) United States Patent
Trottmann et al.

(10) Patent No.: US 7,898,373 B2
(45) Date of Patent: Mar. 1, 2011

(54) MOTOR STARTER

(75) Inventors: Jürgen Trottmann, Falkenberg (DE); Johann Seitz, Amberg (DE); Markus Meier, Rieden (DE)

(73) Assignee: Siemens Aktiengesellschaft, Munich (DE)

( * ) Notice: Subject to any disclaimer, the term of this patent is extended or adjusted under 35 U.S.C. 154(b) by 493 days.

(21) Appl. No.: 11/898,704

(22) Filed: Sep. 14, 2007

(65) Prior Publication Data

US 2009/0015189 A1 Jan. 15, 2009

(30) Foreign Application Priority Data

Sep. 15, 2006 (EP) ..... 06019356

(51) Int. Cl.

| | |
|---|---|
| ***H01H 9/02*** | (2006.01) |
| ***H01H 13/04*** | (2006.01) |
| ***H01H 73/00*** | (2006.01) |
| ***H01H 47/00*** | (2006.01) |

(52) U.S. Cl. ..... 335/202; 335/78; 361/115; 361/142; 361/160; 361/605

(58) Field of Classification Search ..... 335/6, 8, 335/11–13, 78, 85, 159, 161, 162, 185, 169, 335/199, 202, 278, 290; 361/5–6, 115, 142, 361/157, 160, 169.1, 172, 600, 605, 760, 361/801

See application file for complete search history.

(56) References Cited

U.S. PATENT DOCUMENTS

| | | | | |
|---|---|---|---|---|
| 4,085,433 | A * | 4/1978 | Baranowski | 361/744 |
| 4,400,761 | A * | 8/1983 | Hayden et al. | 361/782 |
| 5,567,991 | A | 10/1996 | Schantz | |
| 5,578,980 | A * | 11/1996 | Okubo et al. | 335/132 |
| 5,740,527 | A * | 4/1998 | Mitama | 455/301 |
| 7,309,932 | B2 * | 12/2007 | Tseng | 310/12.16 |
| 7,522,025 | B2 * | 4/2009 | Zeitlberger et al. | 335/199 |
| 2004/0066602 | A1 * | 4/2004 | Kamiya | 361/302 |
| 2007/0159861 | A1 * | 7/2007 | Meier et al. | 363/63 |
| 2009/0167233 | A1 * | 7/2009 | Dornauer et al. | 318/778 |

FOREIGN PATENT DOCUMENTS

| | | |
|---|---|---|
| EP | 0492038 | 7/1992 |
| EP | 735559 | 10/1996 |
| EP | 859393 | 8/1998 |
| WO | WO 2005/101441 | 10/2005 |
| WO | WO 2005099330 A1 * | 10/2005 |
| WO | WO 2005101441 A1 * | 10/2005 |
| WO | WO 2005101642 | 10/2005 |
| WO | WO 2005101642 A1 * | 10/2005 |

OTHER PUBLICATIONS

European Search Report, Jan. 26, 2007.
Office Action for Chinese patent application No. 200710152131.1 dated Aug. 12, 2010 (in German).

* cited by examiner

*Primary Examiner* — Elvin G Enad
*Assistant Examiner* — Mohamad A Musleh
(74) *Attorney, Agent, or Firm* — Harness, Dickey & Pierce, P.L.C.

(57) ABSTRACT

A motor starter whose production is improved is specified. In at least one embodiment, the motor starter includes a power semiconductor switch, an electromechanical bypass switch connected in parallel therewith, and control electronics to drive the bypass switch. In at least one embodiment, the control electronics are in the form of a printed circuit board assembly which is fixed to the bypass switch in an installed position, and the printed circuit board assembly and the bypass switch are designed such that, when being fixed, the printed board assembly makes electrical contact with the bypass switch at the same time.

18 Claims, 5 Drawing Sheets

MOTOR STARTER

PRIORITY STATEMENT

The present application hereby claims priority under 35 U.S.C. §119 on European patent application number EP06019356 filed Sep. 15, 2006, the entire contents of which is hereby incorporated herein by reference.

FIELD

Embodiments of the invention generally relate to a motor starter. For example, at least one embodiment relates to a motor starter having a power semiconductor switch, having an electricomechanical bypass switch connected in parallel with it, and having control electronics for driving the bypass switch.

BACKGROUND

Motor starters may also be referred to as "soft starters". In a motor starter such as this, the motor is connected during a starting phase by the power semiconductor switch which, for example, is in the form of a thyristor, while the parallel bypass switch is open. In this case, the starting power for the motor is continuously and gradually increased, in particular in a regulated form, by appropriately driving the power semiconductor switch, such that the motor starts "softly" rather than suddenly.

During operation of the motor, the power semiconductor switches that are normally used would, however, disadvantageously result in a comparatively high power loss. In order to avoid this power loss, once the starting phase has been completed, the supply current for the motor is no longer passed via the power semiconductor switch but via the bypass switch, whose losses are considerably less, because it is a mechanical switching element.

A conventional electromechanical switching unit is normally used as the bypass switch and generally has a magnetic operating unit in order to operate the actual mechanical switching element. The bypass switch is driven by control electronics which are accommodated in the so-called printed circuit board assembly. The printed circuit board assembly is normally mounted above or alongside the bypass switch and makes contact with the bypass switch by way of essentially free wire lines. The lines are, for example, soldered by appropriate connections to the printed circuit board assembly, and make contact with the bypass switch by way of a plug connection.

This conventional solution is on the one hand comparatively space-consuming, in particular because sufficient free space must be provided for the lines in the enclosure of the motor starter. The contact between the printed circuit board assembly and the bypass switch furthermore involves a comparatively high degree of installation and material complexity. Furthermore, the lines which are essentially loose in the installed state and therefore to a certain extent hang in the appliance in an uncontrolled manner result in a certain risk of interference, in terms of electromagnetic compatibility (EMV) and likewise a certain risk of malfunction as a result of incorrectly connected lines or an incorrect plug contact.

SUMMARY

In at least one embodiment, the invention improves on a motor starter.

According to at least one embodiment of the invention, a printed circuit board assembly and a bypass switch are designed such that they are fixed to one another in an installed state, with the printed circuit board assembly making electrical contact with the bypass switch at the same time during fixing.

The fixing between the printed circuit board assembly and the bypass switch is, in at least one embodiment, designed such that the printed circuit board assembly and the bypass switch form a cohesive, essentially rigid component in the installed state, which cannot be disconnected again, or can be disconnected only by the application of force. The printed circuit board assembly is in this case preferably connected to the bypass switch by a snap-action connection, although other types of attachment, such as screw connection, adhesive bonding, welding etc., can also be used.

The expression fixing for the purposes of at least one embodiment of the invention can, however, also be understood just as fixing the position of the printed circuit board assembly and the bypass switch with respect to one another in such a manner that, when the motor starter is assembled correctly, it is fixed or locked by other components of the motor starter, in particular an enclosure of it.

One essential feature of both variants for the purposes of at least one embodiment of the invention is that the printed circuit board assembly and the bypass switch are arranged in a well-defined position with respect to one another in the installed state, and that, as a consequence of this positioning, the printed circuit board assembly makes electrical contact with the bypass switch at the same time. This avoids the lines which are normally required for the printed circuit board assembly to make contact with the bypass switch, together with any plug contacts and solder contacts, avoiding all of the disadvantages that are normally associated with them.

In one example embodiment, the bypass switch is formed by a mechanical switching element and an operating unit, in particular a magnetic operating unit, for operating it. In one particularly space-saving variant of at least one embodiment of the invention the printed circuit board assembly is in this case expediently designed as a U-shaped hollow form of a hollow form in the form of a trough, which is placed on the operating unit in the installed state so that the operating unit is held in the interior of the hollow form. In addition to saving space, this embodiment has, in particular, the further advantages that it makes it possible to achieve particularly short electrical distances within the circuit formed by the printed circuit board assembly and the operating unit, thus on the one hand making it easier for the printed circuit board assembly to make contact with the bypass switch without the use of lines, while, on the hand, this is advantageous from the EMV aspect. Furthermore, the operating unit and the inner surface of the printed circuit board assembly are in this way effectively shielded by the outer wall of the printed circuit board assembly against mechanical damage, in particular in the course of the manufacturing process. In particular, mechanically sensitive electronic components of the printed circuit board assembly are mounted in a preferred manner on its inner surface, by exploiting this shielding effect.

In the installed position, the printed circuit board assembly is expediently fixed to the operating unit of the bypass switch, and in particular in the immediate vicinity of the contact-making points there. This results in a particularly robust and fail-safe electrical contact being made. In particular, the fixing of the printed circuit board assembly to the operating unit is also advantageous when the operating unit of the bypass switch can be disconnected from the actual switching element. In this case, the operating unit and the printed circuit board assembly can first of all be connected and have contact made between them separately in the course of the installation process, being fitted as one component to the switching element only during a subsequent manufacturing step, which is advantageous from a production-engineering point of view.

At least one spring contact is preferably provided in order to make contact between the printed circuit board assembly and the bypass switch, in particular with its operating unit, in a manner which can be achieved easily from the production-engineering point of view, costs little and is fail-safe.

In order to make it easier not only to populate the printed circuit board assembly with electronic components but also to fit the printed circuit board assembly to the bypass switch, the printed circuit board assembly is expediently designed to be flexible. In one example embodiment, the printed circuit board assembly is provided with nominal bending points, in particular in the form of film hinges, about which the printed circuit board assembly can be bent without being destroyed. Alternatively or additionally, the printed circuit board assembly may optionally also be composed of a plurality of pieces.

BRIEF DESCRIPTION OF THE DRAWINGS

One example embodiment of the invention will be explained in more detail in the following text with reference to the drawings, in which.

Mutually corresponding parts are always provided with the same reference symbols in all of the figures.

DETAILED DESCRIPTION OF THE EXAMPLE EMBODIMENTS

Figure 1:
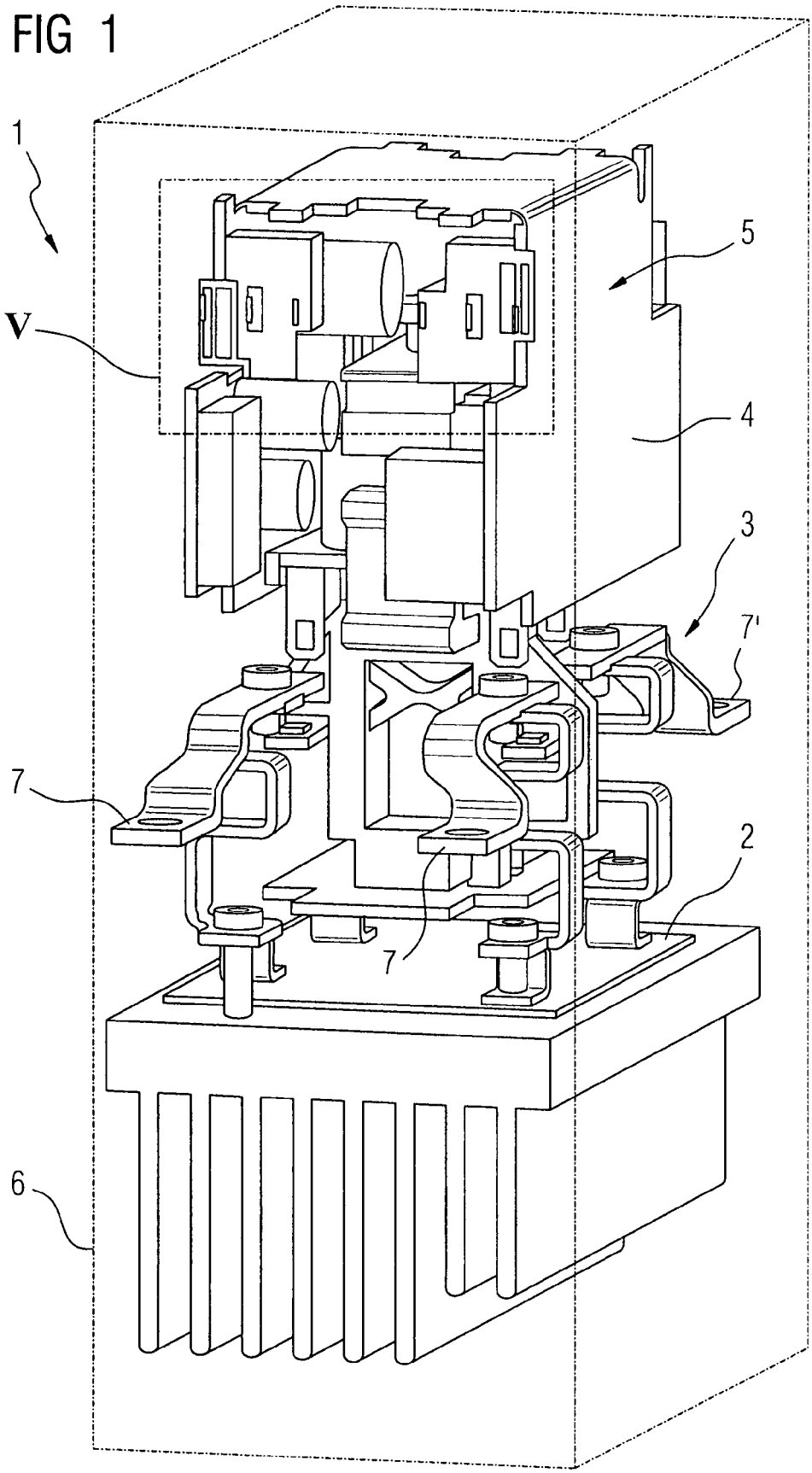
FIG. 1 shows a schematic perspective view of a motor starter with a power semiconductor switch, an electromechanical bypass switch connected in parallel with it, and with a printed circuit board assembly which contains control electronics for driving the bypass switch.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referencing the drawings, wherein like reference numerals designate identical or corresponding parts throughout the several views, example embodiments of the present patent application are hereafter described. Like numbers refer to like elements throughout. As used herein, the terms "and/or" and "at least one of" include any and all combinations of one or more of the associated listed items.

The motor starter 1 illustrated in FIG. 1 has a power semiconductor switch 2, in particular a thyristor. The motor starter 1 also has an electromechanical bypass switch 3, which is connected in parallel with the power semiconductor switch 2, and a printed circuit board assembly 4, which is fitted with control electronics 5 for driving the bypass switch 3.

The power semiconductor switch 2, the bypass switch 3 and the printed circuit board assembly 4 are accommodated in a common enclosure 6, which is indicated just by outlines in FIG. 1, in the installed state as shown in FIG. 1. In the installed state, only connecting contacts 7 and 7' for connection of a drive power line for a motor (not illustrated) project out of the enclosure 6.

In the embodiment shown in FIG. 1, the motor starter 1 is designed to be connected in a drive power line (which in this case by way of example has two phases) for a motor. In a corresponding manner, the motor starter 1 has in each case one pair of connecting contacts 7 and 7' for each of the two phase lines, which project on opposite sides out of the enclosure 6 and can be respectively connected to the mains-side part and to a motor-side part of the drive power line.

Internally, the power semiconductor 2 and the bypass switch 3 are connected internally in parallel between the associated connecting contacts 7, 7'.

When being used correctly, the motor starter 1 is connected upstream of the electrically powered motor in the drive power line and is used for switching the motor on and off. The motor starter 1 is in this case so-called soft starter, in which the motor power is increased gradually, in particular in a regulated manner, during a motor starting phase. In this starting phase, the bypass switch 3 is open, and the motor is therefore connected to the mains only by the power semiconductor switch 2. The gradual, in particular regulated, increase in the motor power is in this case achieved by appropriately driving the power semiconductor switch 2. In order to save the power loss which is incurred across the power semiconductor switch 2 during operation of the motor, the bypass switch 3 is closed once the starting phase has ended, and the power semiconductor switch 2 is therefore bridged, so that the drive current for the motor flows via the bypass switch 3, with low losses.

Figure 2:
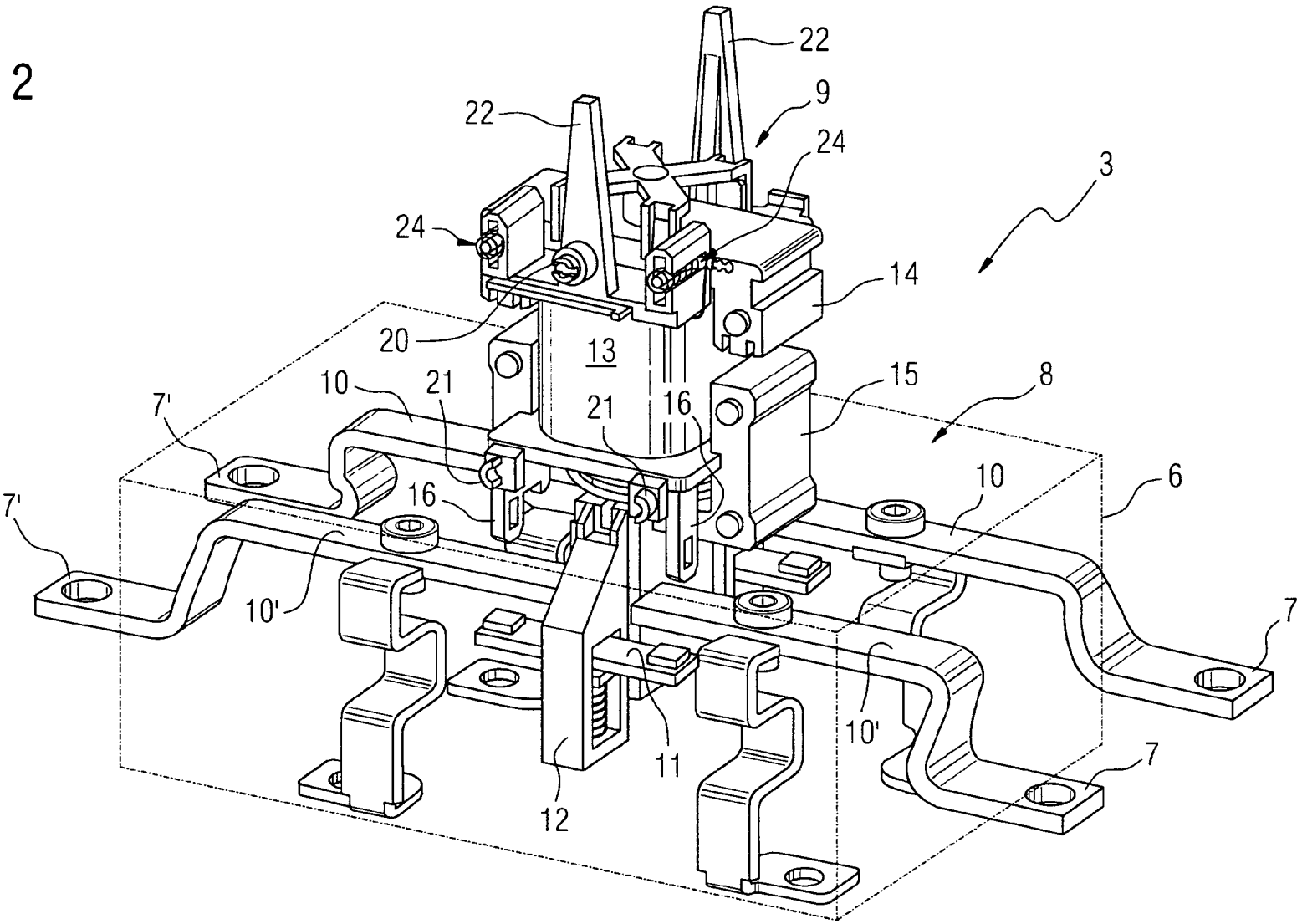
FIG. 2 shows a perspective illustration, rotated with respect to that shown in FIG. 1, of the bypass switch for the motor starter with a mechanical switching element and an electromechanical operating unit.

The bypass switch 3, which is illustrated separately once again in FIG. 2, for the motor starter 1 has a mechanical switching element 8, which can be switched by way of an electromagnetic operating unit 9.

For each phase line, the switching element 8 has in each case one pair of mutually opposite fixed contacts 10, 10', each of which is electrically connected to a corresponding connecting contact 7 or 7', respectively. The fixed contacts 10 and 10' of the same phase line can each be electrically reversibly connected and disconnected via a moving contact link 11.

All of the contact links 11 are connected to a common plunger 12 and are always operated jointly by movement of the plunger 12. The plunger 12 is prestressed by a spring (which is not illustrated in any more detail) such that the contact links 11 are locked in an open position, as illustrated in FIG. 2, in the rest state, in which the connecting contacts 7, 7' of each phase line are electrically disconnected from one another.

The operating unit 9 has a magnet coil 13 and a magnet yoke 14, which form a magnetic circuit with a magnet armature 15. The magnet armature 15 is in this case attached to the plunger 12 and therefore, from the physical point of view, forms a component of the switching element 8. The components of the operating unit 9, that is to say in particular the magnet coil 13 and the magnet yoke 14, are combined to form a cohesive and essentially rigid assembly, which is attached to the switching element 8 by way of a snap-action connection 16.

In the installed state, a magnetic field is produced in the magnetic circuit by application of a voltage to the magnet coil 13. Under the influence of this magnetic field, the magnet armature 15 is attracted to the magnet yoke 14 and, during this process, the contact links 11 are moved via the plunger 12 against the spring pressure from the open position to a closed position, in which the mutually associated fixed contacts 10, 10' of each phase line are electrically conductively connected to one another via the contact link 11.

Figure 3:
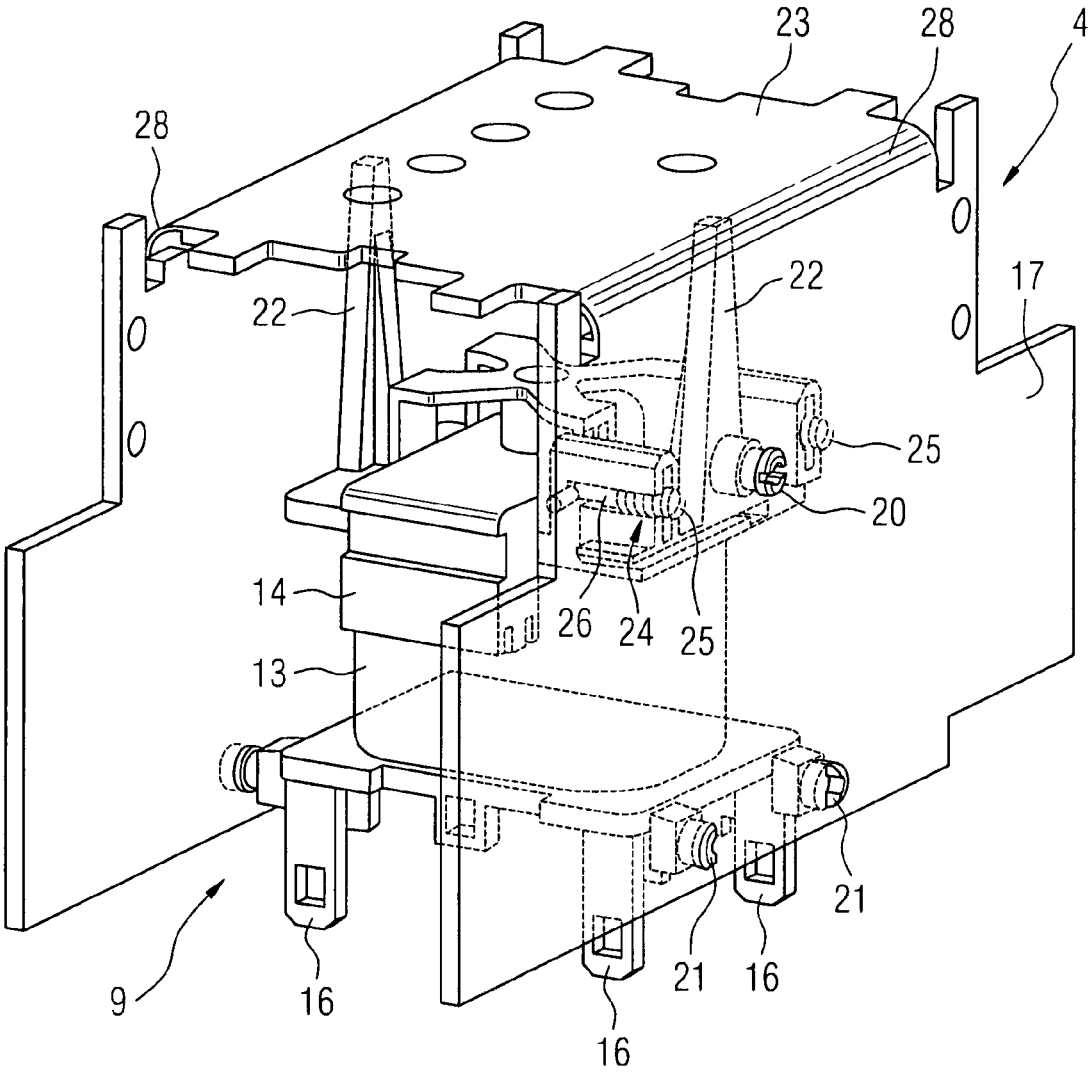
FIG. 3 shows a perspective illustration, once again rotated, of the operating unit of the bypass switch with a printed circuit board of the printed circuit board assembly mounted on it.
Figure 4:
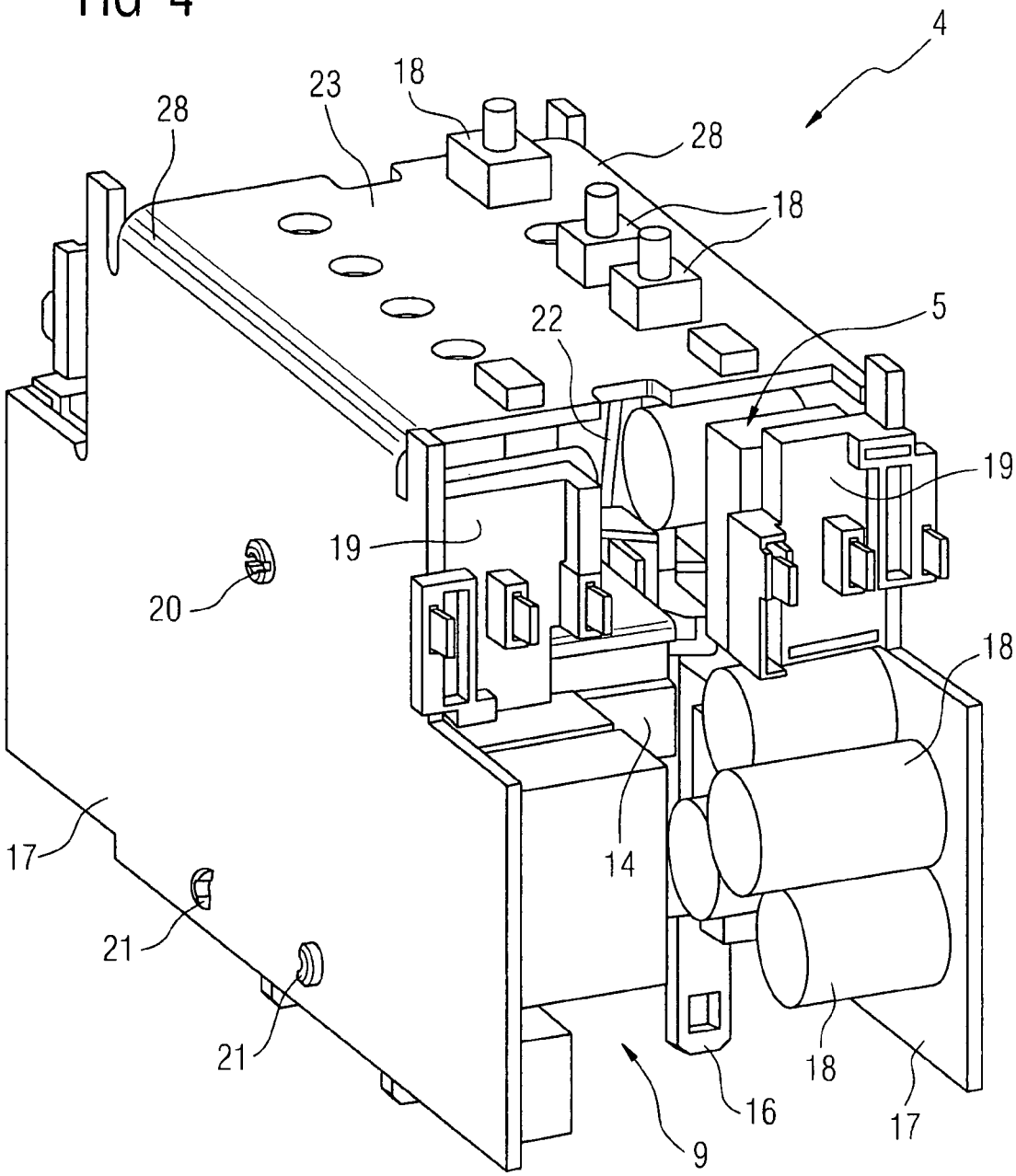
FIG. 4 shows a perspective illustration, once again rotated, of the operating unit and of the printed circuit board, which is now populated with electronic components, of the printed circuit board assembly.

The printed circuit board assembly 4, which is shown separately in FIGS. 3 and 4 together with the operating unit 9, is formed essentially from a printed circuit board 17 with electronic components 18 mounted on it, which are connected to form the control electronics 5. FIG. 3 in this case shows the unpopulated printed circuit board 17, for the sake of clarity. The printed circuit board 17 populated with the components 18 is shown in FIG. 4.

As can be seen from the illustrations, the printed circuit board 17 is bent in the installed state to form a hollow shape which essentially has a U-shaped cross section and holds the operating unit 9 in its interior. The electronic components 18 of the printed circuit board assembly 4 are in this case predominantly mounted on the inner surface of the printed circuit board 17, facing the operating unit 9. On the one hand, this has the advantage that the space available in the interior of the printed circuit board 17 that is not occupied by the operating unit 9 is made particularly good use of, and that, on the other hand, the components 18 are well shielded from the exterior and are therefore protected against mechanical damage, for example during the installation process.

As can be seen from FIG. 4 relatively small (printed circuit board) attachments 19 are plugged onto the end faces of the printed circuit board 17 and partially cover the end surfaces of the printed circuit board 17. The attachments 19 may be fitted with further electronic components 18 and therefore enlarge the useful area of the printed circuit board 17 that is available for fitting the control electronics 5. It also offers additional protection for the control electronics 5 and for the operating unit 9 against mechanical damage.

As can be seen from FIGS. 3 and 4, the printed circuit board 17 is fixed to the operating unit 9 by way of snap-action connections 20, 21, so that the printed circuit board assembly 4 and the operating unit 9 form an assembly which is cohesive in a self-supporting manner and is essentially rigid. The mechanical robustness of this assembly is improved by two supporting arms 22, which project from the operating unit 9 and are supported at the free end on a cover 23 for the printed circuit board 17.

Figure 5:
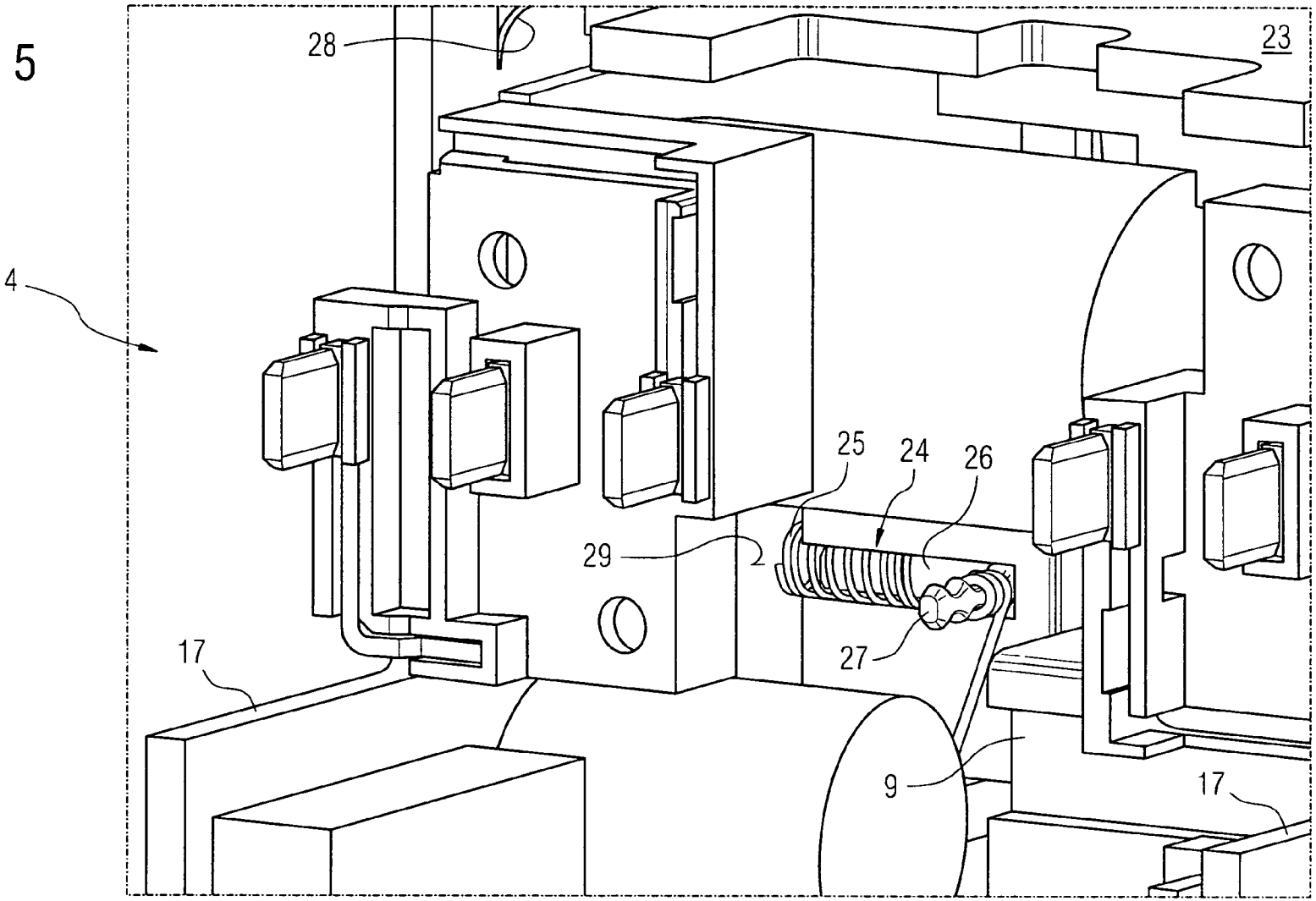
FIG. 5 shows an enlarged detail V from FIG. 1 of a spring contact for making contact between the printed circuit board assembly and the bypass switch element.

As can be seen in particular from FIG. 5, which shows an enlarged detailed illustration from FIG. 1 and FIG. 2, contact is made between the printed circuit board assembly 4 and the operating unit 9 via two spring contacts 24. Each spring contact 24 has a compression spring 25 composed of electrically conductive material, which is pushed onto a guide pin 26 which projects from the operating unit 9. The compression spring 25 is in this case preferably clamped onto the guide pin 26 and is thus held captive on the operating unit 9. Each guide pin 26 internally makes contact with a coil connection 27 of the magnet coil 13.

In order to simplify the assembly of the motor starter 1, the printed circuit board 17 is provided with flexible nominal folding points 28 in the form of film hinges, which make it possible to bend the printed circuit board 17 from its originally flat state to the U-shape that can be seen in FIGS. 3 and 4, without destroying it. The printed circuit board 17 is expediently populated with the electronic components 18 when in the flat state. The complete printed circuit board assembly 4 is then snapped onto the operating unit 9, and is folded to the said U-shape during this process. In this case, the printed circuit board 17 is provided on its inner surface with conductive contact pads 29 which are arranged such that the compression spring 25 of each spring contact 24 is pressed against one of the contact pads 29 while the printed circuit board 17 is being snapped on. Thus, the printed circuit board assembly 4 makes contact with the operating unit 9 at the same time when the printed circuit board 17 is being snapped onto the operating unit 9.

Once the printed circuit board assembly 4 has been snapped onto the operating unit 9, the assembly that is formed in this way is snapped onto the switching element 8, and the bypass switch 3, that is completed in this way, is connected to the power semiconductor switch 2.

Overall, this results in a motor starter 1 which cannot only be produced easily but is also compact and saves material, and which furthermore is better than conventional motor starters of the type mentioned initially both with respect to EMC criteria and with respect to fail-safety.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDS; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. Motor starter, comprising:

a power semiconductor switch;

an electromechanical bypass switch connected in parallel with the power semiconductor switch; and control electronics to drive the bypass switch, the control electronics including a printed circuit board assembly fixed to the electromechanical bypass switch in an installed state, the printed circuit board assembly and the bypass switch being designed such that, when being fixed, the printed circuit board assembly makes electrical contact with the bypass switch at the same time, the printed circuit board assembly having at least two printed circuit board sides forming at least one of a U-shaped hollow form and a hollow form in the form of a trough, and an operating unit, comprising a magnet coil and a magnet yoke, being located between the at least two printed circuit board sides, in an installed state, and facing electronic components on the printed circuit boards.

2. The motor starter as claimed in claim 1, wherein the bypass switch includes a mechanical switching element and the operating unit operates the switching element.

3. The motor starter as claimed in claim 2, wherein the printed circuit board assembly is fixed to the operating unit in the installed position.

4. The motor starter as claimed in claim 3, wherein the printed circuit board assembly and the operating unit are fixed as a cohesive assembly to the switching element in the installed state.

5. The motor starter as claimed in claim 3, wherein at least one electronic component on the printed circuit board assembly is arranged on an inside of the printed circuit board assembly, facing the operating unit in the installed position.

6. The motor starter as claimed in claim 2, wherein at least one electronic component on the printed circuit board assembly is arranged on an inside of the printed circuit board assembly, facing the operating unit in the installed position.

7. The motor starter as claimed in claim 2, wherein the operating unit is an electromagnetic operating unit.

8. The motor starter as claimed in claim 2, wherein the printed circuit board assembly makes contact with the bypass switch via at least one spring contact.

9. The motor starter as claimed in claim 1, wherein the printed circuit board assembly makes contact with the bypass switch via at least one spring contact.

10. The motor starter as claimed in claim 1, wherein the printed circuit assembly is fixed to the bypass switch by way of a snap-action connection.

11. The motor starter as claimed in claim 1, wherein the operating unit is fixed to the switching element by way of a snap-action connection.

12. The motor starter as claimed in claim 1, wherein the printed circuit board assembly includes a flexible printed circuit board and has three sides formed from a plurality of printed circuit board pieces.

13. The motor starter as claimed in claim 1, wherein the at least two printed circuit board sides have at least one flexible nominal folding point.

14. The motor starter as claimed in claim 1, wherein the operating unit includes a supporting arm that projects from a surface of the operating unit that supportingly contacts a top portion of the printed circuit board assembly.

15. Motor starter, comprising:

a power semiconductor switch;

an electromechanical bypass switch connected in parallel with the power semiconductor switch;

a printed circuit board assembly that includes at least two sides formed by printed circuit boards that create a hollow form, the printed circuit board assembly being fixed to the bypass switch in an installed position, the printed circuit board assembly and the bypass switch being designed such that, when being fixed, the printed board assembly makes electrical contact with the bypass switch at the same time; and an operating unit, comprising a magnet coil and a magnet yoke, located between the at least two sides formed by the printed circuit boards and facing electronic components on the printed circuit boards.

16. The motor starter as claimed in claim 15, wherein the bypass switch includes a mechanical switching element and the operating unit operates the switching element.

17. The motor starter as claimed in claim 16, wherein the printed circuit board assembly is fixed to the operating unit in the installed position.

18. The motor starter as claimed in claim 15, wherein the electronic components are mounted on an inner surface of at least one of the printed circuit boards that create a hollow form in the form of a trough facing the operating unit.

* * * * *